US008411890B2

(12) United States Patent
Ooi

(10) Patent No.: US 8,411,890 B2
(45) Date of Patent: Apr. 2, 2013

(54) HEARING AID

(75) Inventor: Wai Loon Ooi, Singapore (SG)

(73) Assignee: Siemens Medical Instruments Pte. Ltd., Singapore (SG)

( * ) Notice: Subject to any disclaimer, the term of this patent is extended or adjusted under 35 U.S.C. 154(b) by 219 days.

(21) Appl. No.: 12/934,495

(22) PCT Filed: Mar. 27, 2008

(86) PCT No.: PCT/SG2008/000095

§ 371 (c)(1),
(2), (4) Date: Sep. 24, 2010

(87) PCT Pub. No.: WO2009/120149

PCT Pub. Date: Oct. 1, 2009

(65) Prior Publication Data

US 2011/0019850 A1 Jan. 27, 2011

(51) Int. Cl.
*H04R 25/00* (2006.01)

(52) U.S. Cl. ..... 381/330; 381/328; 381/381

(58) Field of Classification Search ..... 381/322, 381/324–325, 327–328, 330, 380–381
See application file for complete search history.

(56) References Cited

U.S. PATENT DOCUMENTS

| | | | | |
|---|---|---|---|---|
| 6,212,283 | B1 | 4/2001 | Fletcher et al. | |
| 7,027,608 | B2 | 4/2006 | Fretz et al. | |
| 7,751,580 | B2 * | 7/2010 | Bauman | 381/330 |
| 2005/0238192 | A1 | 10/2005 | Ford et al. | |
| 2007/0036379 | A1 | 2/2007 | Anderson et al. | |
| 2008/0285786 | A1 | 11/2008 | van der Bilt et al. | |

FOREIGN PATENT DOCUMENTS

| | | | |
|---|---|---|---|
| EP | 1705949 | A1 | 9/2006 |
| WO | 9904601 | A1 | 1/1999 |

* cited by examiner

*Primary Examiner* — Suhan Ni
(74) *Attorney, Agent, or Firm* — Laurence A. Greenberg; Werner H. Stemer; Ralph E. Locher

(57) ABSTRACT

In an embodiment, a hearing aid is provided. The hearing aid may include a behind-the-ear component, a sound tube coupled with the behind-the-ear component at its one end, and a loudspeaker coupled with the sound tube at the other end of the sound tube opposite to the behind-the-ear component. The hearing aid may further include a joint connected between the loud-speaker and the sound tube, wherein the joint is moveable or flexible such that a degree of freedom in movement is provided in a direction substantially perpendicular to an insertion direction of the loudspeaker into an ear canal.

9 Claims, 2 Drawing Sheets

HEARING AID

FIELD OF THE INVENTION

Embodiments of the invention relate to a hearing aid.

BACKGROUND OF THE INVENTION

A behind-the-ear (BTE) hearing aid usually includes a behind-the-ear component to be worn behind the ear. The behind-the-ear component usually further includes a microphone for collecting sound waves and a signal processing circuit (also referred to as speech processing circuit) for processing the collected sound waves.

The sound waves may be conducted to the ear by means of a sound tube connected to the behind-the-ear component at its one end, wherein the other end of the sound tube may be coupled with an earmould. Due to different physiology of ears of different users, the earmould is usually custom made, e.g. by taking the impression of the ear, to fit into the ear canal of different users.

The sound waves may also be conducted to the ear by means of a wire, e.g. housed in a sound tube, and a speaker (which may also be referred to as a receiver in the field of hearing aids) placed in the ear canal. Such a hearing aid is also referred to as a receiver in the ear aid. For example, as shown in FIG. 1, a sound tube 102 is coupled with the speaker 104, with at least one wire 106 housed within the sound tube 102 and connecting the speaker 104 with the behind-the-ear component (not shown).

The sound tube 102 is coupled with the speaker 104 such that the speaker 104 has a fixed predefined entry position to be put into the ear canal. A dome structure 108 made of a soft material may be assembled to the speaker 104 which covers the opening of the ear canal by its large surface. The soft dome structure 108 may help to decrease the uncomfortableness, but the size, shape and position of the soft dome structure 108 may still induce pain to some part of the ear canal due to different physiology of the ear.

SUMMARY OF THE INVENTION

In various embodiments of the invention, a hearing aid is provided, which is more comfortable to wear in an easy and cost-effective manner.

An embodiment of the invention relates to a hearing aid. The hearing aid may include a behind-the-ear component, a sound tube coupled with the behind-the-ear component at its one end, and a loudspeaker coupled with the sound tube at the other end of the sound tube opposite to the behind-the-ear component. The hearing aid may further include a joint connected between the loudspeaker and the sound tube, wherein the joint is moveable or flexible such that a degree of freedom in movement is provided in a direction substantially perpendicular to an insertion direction of the loudspeaker into an ear canal.

By providing a moveable or flexible joint configured to be connected between the loudspeaker and the sound tube, the joint and the loudspeaker connected thereto is allowed to be moved in a range of angle along a predefined axis. Due to the provided degree of freedom in movement, the loudspeaker may be well fitted into the ear, e.g. the ear canal opening, with more comfort in an easy and cost-effective manner. In an example, the direction substantially perpendicular to the insertion direction of the loudspeaker into an ear canal may be understood to refer to a direction that is perpendicular to a plane that lies horizontally at the level of the ear canal. It should be mentioned that the "degree of freedom in movement" is intended to include any kind of movement in any direction which includes one movement vector component non-equal to zero in the direction the degree of freedom refers to.

The joint enables the easy and convenient adaptation of the positioning of the components of the hearing aid worn in the ear canal, for example, to the varying physiology of different users, thereby improving the wearing comfort of the user. Illustratively, position of e.g. the loudspeaker in the ear canal may easily be changed using the joint in order to avoid positions which may be painful for the user.

In an embodiment, the hearing aid further includes at least one wire running through the sound tube and the joint, and the at least one wire may connect the behind-the-ear component and the loudspeaker.

The behind-the-ear component may include one or more microphones. The microphone may be an omnidirectional microphone (also referred to as a spherical microphone, which is configured to record in all direction) in one embodiment, and may be a directional microphone (e.g. unidirectional microphone or bi-directional microphone) in another embodiment.

The behind-the-ear component may also include a signal processing circuit (also referred to as speech processing circuit), which may be used to process, such as filter and/or amplify, the electrical signal, e.g. received from the at least one microphone.

In an embodiment, the signal processing circuit may be mounted on a printed circuit board. In other embodiments, other circuits or elements, which may be provided or desired in a hearing aid, may be provided on the printed circuit board as well.

The microphone may be connected with the signal processing circuit, e.g. via one or more wires. In an alternative example, the at least one microphone may be coupled with the signal processing circuit via any other suitable connection such as radio connection, if appropriate.

In another embodiment, the loudspeaker (also referred to as a receiver or transducer), which outputs sound waves to be emitted into the ear (e.g. into the pinna or the ear canal) of the user of the hearing aid, may be connected with the signal processing circuit via at least one wire as well. The signal processing circuit may transmit the processed electrical signal to the loudspeaker via the at least one wire, for example.

In an embodiment, the hearing aid may further include a hook between the behind-the-ear component and the sound tube, such that the behind-the-ear component may be fixed on the ear. Any other type of fixing member to fix the behind-the-ear component behind the ear may be provided in an alternative embodiment of the invention.

The sound tube may be made of a plastic material (e.g. a soft plastic material) in one embodiment. In another embodiment, the sound tube may be made of a flexible material, e.g., rubber or silicone. In an alternative embodiment, the sound tube may be made of inflexible material as well, such as a metal (e.g. titanium).

In an embodiment, the loudspeaker may have a dome shape, such that the loudspeaker is easier to be held in the ear, e.g. at the ear canal. In an alternative embodiment, the loudspeaker may be at least partially covered by a plastic or silicone dome shaped cover, so as to be held in the ear.

In an embodiment, the joint may be made of a rubber material. In other embodiments, the joint may be made of other suitable flexible material, being of natural or synthetic origins, which can be deformed and after having been deformed and the stress removed, returns with force back into its original shape. Examples of flexible material which may be used in the joint include soft plastic, silicone, etc.

In a further embodiment, the joint may be made of an inflexible material. In one example, the joint may be made of hard plastic material. In another example, the joint may be made of a metal. In these embodiments, the shape or structure of the joint may be configured to allow a degree of freedom in movement in a direction substantially perpendicular to an insertion direction of the loudspeaker into an ear canal.

In an embodiment, the joint may include a ball, such that the joint is moveable or flexible to provide a degree of freedom in movement in a direction substantially perpendicular to an insertion direction of the loudspeaker into an ear canal. In another embodiment, the joint may include a ball so as to provide a degree of freedom in rotational movement substantially surrounding an insertion direction of the loudspeaker into an ear canal. This rotational movement would include the direction substantially perpendicular to an insertion direction of the loudspeaker into an ear canal.

In an alternative embodiment, the joint may have a sleeve shape. The joint is configured to provide a degree of freedom in movement in a direction substantially perpendicular to an insertion direction of the loudspeaker into an ear canal, or to provide a degree of freedom in rotation substantially surrounding an insertion direction of the loudspeaker into an ear canal.

The joint may have other suitable shapes as well, as long as a degree of freedom in movement or in rotation is provided at the joint, e.g. as described above.

In the drawings, like reference characters generally refer to the same parts throughout the different views. The drawings are not necessarily to scale, emphasis instead generally being placed upon illustrating the principles of the invention. In the following description, various embodiments of the invention are described with reference to the following drawings, in which:

DESCRIPTION OF THE INVENTION

Figure 1:
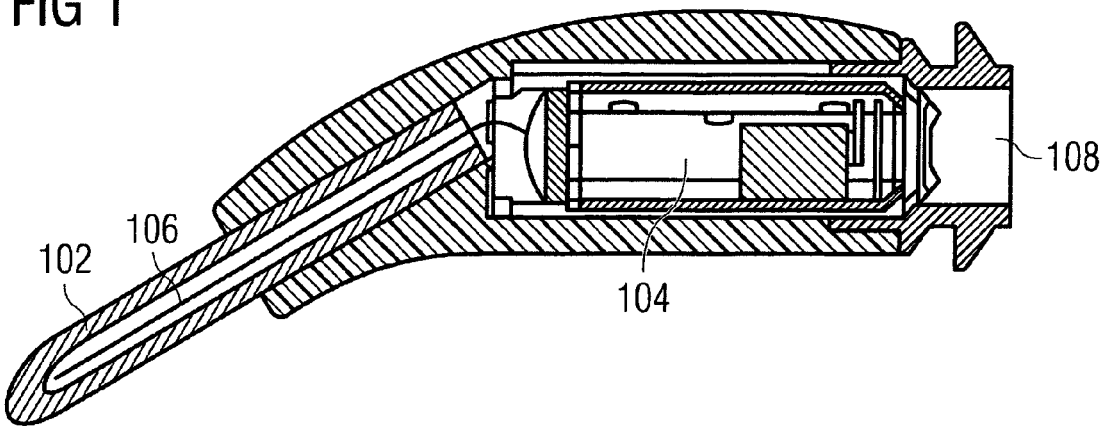
FIG. 1 shows a cross-section of a portion of a hearing aid.
Figure 2:
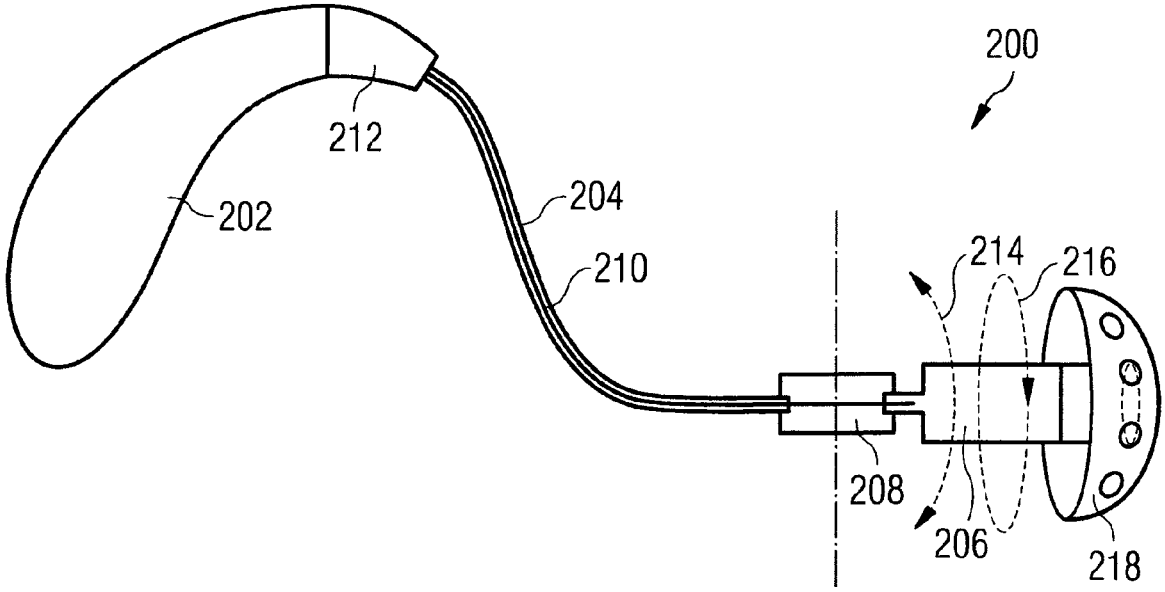
FIG. 2 shows a hearing aid according to an embodiment of the invention.

FIG. 2 shows a hearing aid 200 according to an embodiment of the invention.

The hearing aid 200 may include a behind-the-ear component 202, a sound tube 204 coupled with the behind-the-ear component 202 at its one end, and a loudspeaker 206 coupled with the sound tube 204 at the other end of the sound tube 204 opposite to the behind-the-ear component 202. The hearing aid may further include a joint 208 connected between the loudspeaker 206 and the sound tube 204.

The hearing aid 200 may include at least one wire 210 running through the sound tube 204 and the joint 208 and connecting the behind-the-ear component 202 and the loudspeaker 206. The at least one wire 210 may be housed within the sound tube 204 and the joint 208 as shown in FIG. 2.

The behind-the-ear component 202 may include therein one or more microphone (not shown in FIG. 2) for collecting sound waves and generating electrical signal based on the collected sound waves. The behind-the-ear component 202 may further include therein a signal processing circuit (not shown) for processing the electrical signals received from the at least one microphone, e.g. by means of filtering, dynamically compressing, amplifying, etc. The thus processed electrical signal provided by the signal processing circuit at an output thereof may then be transmitted to the loudspeaker 206, e.g. by means of one of the at least one wire 210.

In order to fix the hearing aid 200 along the contour of the ear, the hearing aid 200 may optionally include a hook 212 between the behind-the-ear component 202 and the sound tube 204.

The sound tube 204 may be made of plastic material in one example, and may be made of other flexible material, in another example, to protect the wire 210 housed therein, for example.

The joint 208 may be made of rubber material in an embodiment, and may be made of other flexible material, such as soft plastic or silicone, in another embodiment, such that the joint 208 is moveable or flexible to be provided with a degree of freedom in movement.

The joint 208 may be made of inflexible material in another embodiment. For example, the joint 208 may be made of hard plastic material or a metal, as long as a degree of freedom in movement in a direction substantially perpendicular to an insertion direction of the loudspeaker 206 into an ear canal is provided, e.g., by configuring the shape or structure of the joint 208.

As shown in FIG. 2, the joint 208 has a sleeve shape, wherein the joint 208 and the loudspeaker 206 are allowed to be moveable in a direction 214 substantially perpendicular to an insertion direction of the loudspeaker 206 into an ear canal. In another embodiment, the moveable/flexible sleeve shaped joint 208 and the loudspeaker 206 may be provided with a degree of freedom to be rotated in a direction 216 substantially surrounding an insertion direction of the loudspeaker into an ear canal.

The loudspeaker 206 may be in a dome shape to be fitted into the ear canal, for example. In another embodiment, the loudspeaker 206 may be assembled at one end with a dome structure 218, e.g. being made of soft flexible material, such that the dome structure 218 may be fitted into the ear canal.

Figure 3:
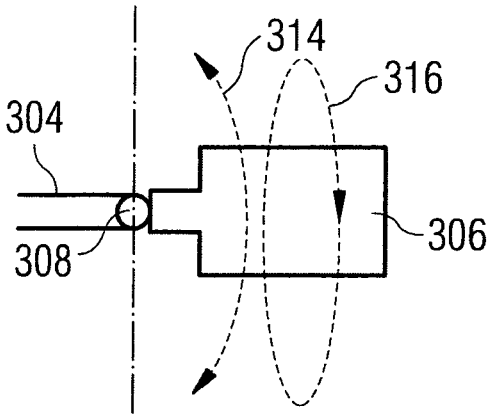
FIG. 3 shows a hearing aid according to another embodiment of the invention.

FIG. 3 shows a portion of a hearing aid according to another embodiment of the invention.

As shown in FIG. 3, the sound tube 304 is connected with the loudspeaker 306 via the joint 308. In this embodiment, the joint 308 includes a ball, which may be made of flexible material as described above. The flexible ball structure as included in the joint 308 allows movement of the joint 308 and the loudspeaker 306 in a direction 314 substantially perpendicular to an insertion direction of the loudspeaker 306 into an ear canal in an embodiment. In another embodiment, the flexible ball structure included in the joint 308 allows the movement, e.g. the rotation, of the joint 308 and the loudspeaker 306 in a direction 316 substantially surrounding an insertion direction of the loudspeaker into an ear canal.

It is noticed that the ball structure herein include a spherical structure or an oval structure. The joint 308 may include any other suitable shaped structure, which may allow a degree of freedom in movement at the joint 308.

Figure 4:
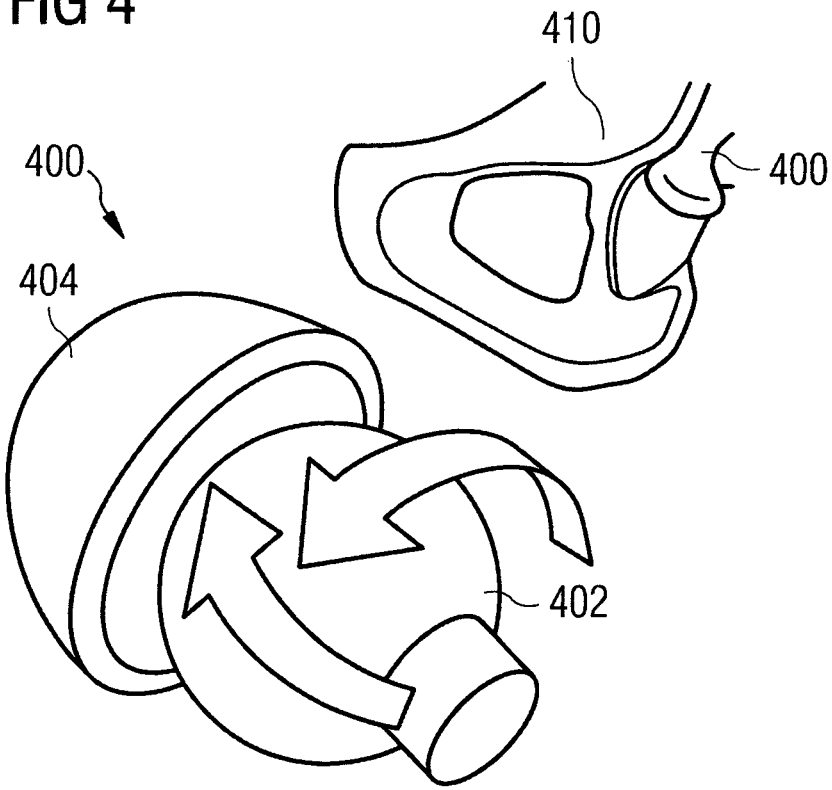
FIG. 4 shows a joint according to an embodiment of the invention.

An example of a joint 400 including a ball structure in an embodiment is shown in FIG. 4.

The joint 400 includes a ball structure 402, one end of which may be connected with a sound tube of the hearing aid. The other end of the ball structure 402 may be coupled with a coupling structure 404, e.g. in the shape of a half-ball shell as shown in FIG. 4.

The joint 400 may be connected to an ear mould 410 via the coupling structure 404. In another example, the joint 400 may be connected to a loudspeaker (not shown). In a further example, the joint 400 may be connected to a loudspeaker embedded in an ear mould 410.

The coupling structure 404 and the ball structure 402 may be made of metal in an example, and may be made of other inflexible or flexible material in other examples.

The coupling structure 404 is coupled with the ball structure 402, e.g. to allow the ball structure 402 to be moveable within the coupling structure 404, such that a degree of movement is provided in a direction substantially perpendicular to an insertion direction of the loudspeaker (not shown) into an ear canal in an embodiment. In another embodiment, the coupling structure 404 is coupled with the ball structure 402 to allow the movement, e.g. the rotation, of the ball structure 402 in a direction substantially surrounding an insertion direction of the loudspeaker into an ear canal.

While the invention has been particularly shown and described with reference to specific embodiments, it should be understood by those skilled in the art that various changes in form and detail may be made therein without departing from the spirit and scope of the invention as defined by the appended claims. The scope of the invention is thus indicated by the appended claims and all changes which come within the meaning and range of equivalency of the claims are therefore intended to be embraced.

The invention claimed is:

1. A hearing aid, comprising:

a behind-the-ear component;

a sound tube formed of flexible material, said sound tube having a first end coupled with said behind-the-ear component and a second end opposite said first end;

a loudspeaker coupled with said second end of said flexible sound tube opposite said behind-the-ear component; and a joint connected between said loudspeaker and said flexible sound tube, wherein said joint is made of a rubber material or comprises a ball, and said joint is moveable or flexible such that a degree of freedom in movement is provided in a direction substantially perpendicular to an insertion direction of said loudspeaker into an auditory canal of an ear.

2. The hearing aid according to claim 1, further comprising:

at least one wire running through said sound tube and said joint, and connecting said behind-the-ear component with said loudspeaker.

3. The hearing aid according to claim 1, wherein said behind-the-ear component comprises a microphone.

4. The hearing aid according to claim 1, wherein said behind-the-ear component comprises a signal processing circuit.

5. The hearing aid according to claim 1, further comprising a hook between said behind-the-ear component and said sound tube.

6. The hearing aid according to claim 1, wherein said sound tube is made of a plastic material.

7. The hearing aid according to claim 1, wherein said loudspeaker is a constructed at one end with a dome structure.

8. The hearing aid according to claim 1, wherein said joint is made of a plastic material or a metal.

9. The hearing aid according to claim 1, wherein said joint has a sleeve shape.

* * * * *